US006510304B2

(12) United States Patent
Abramsohn

(10) Patent No.: US 6,510,304 B2
(45) Date of Patent: Jan. 21, 2003

(54) AUGER FOR MAGNETIC MATERIALS WITH SPECIFIC USE FOR DEVELOPER TRANSPORT IN ELELCTROGRAPHIC PRINTING SYSTEMS

(75) Inventor: Dennis A. Abramsohn, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/875,652

(22) Filed: Jun. 6, 2001

(65) Prior Publication Data

US 2002/0186988 A1 Dec. 12, 2002

(51) Int. Cl.[7] ..... G03G 15/08
(52) U.S. Cl. ..... 399/256; 399/254
(58) Field of Search ..... 399/254, 256, 399/259, 262, 263; 366/273

(56) References Cited

U.S. PATENT DOCUMENTS 4,056,076 A 11/1977 Smith
4,274,362 A 6/1981 Beck et al.
4,987,853 A * 1/1991 Mauer et al. ..... 399/256
5,453,820 A * 9/1995 Ueno et al. ..... 399/254 X
5,465,138 A * 11/1995 Jaskowiak et al. ..... 399/254 X
5,617,189 A * 4/1997 De Cock et al. ..... 399/254

FOREIGN PATENT DOCUMENTS

JP 61-052665 * 3/1986
JP 11-352857 * 12/1999

* cited by examiner

*Primary Examiner*—Sandra Brase
(74) *Attorney, Agent, or Firm*—Lloyd R. Bean, II

(57) ABSTRACT

A development system including a housing, a developer roll mounted in the housing, for depositing marking particles on an imaging surface having an electrostatic latent image thereon, an auger, for mixing and transporting the marking particles and carrier constituents of the developing material and; transferring mixed developer material to the developer roll, the auger comprising an elongate strip of magnetic material having a helix structure; a nonmagnetic sleeve enclosing the elongate strip of magnetic material; and means for rotating the elongate strip of magnetic material within the nonmagnetic sleeve, the elongate strip of magnetic material generates a magnetic field for transporting the developer material axially along an outer surface of the nonmagnetic sleeve when rotated by the rotating means.

9 Claims, 3 Drawing Sheets

AUGER FOR MAGNETIC MATERIALS WITH SPECIFIC USE FOR DEVELOPER TRANSPORT IN ELELCTROGRAPHIC PRINTING SYSTEMS

BACKGROUND AND SUMMARY

The invention relates generally to an electrophotographic printing machine and, more particularly, to a development system which includes a magnetic auger assembly, mounted in a housing, for mixing and transporting developer materials.

Generally, an electrophotographic printing machine includes a photoconductive member which is charged to a substantially uniform potential to sensitize the surface thereof. The charged portion of the photoconductive member is exposed to a light image of an original document being reproduced or is imagewise exposed by a raster scanned beam controlled by a digital image. This records an electrostatic latent image on the photoconductive member corresponding to the informational areas contained within the original document. After the electrostatic latent image is formed on the photoconductive member, the image is developed by bringing a developer material into contact therewith.

Generally, the developer material comprises toner particles adhering triboelectrically to carrier granules. The toner particles are attached to the latent image from the carrier granules to form a powder image on the photoconductive member which is subsequently transferred to a copy sheet. Finally, the copy sheet is heated to permanently affix the powder image thereto in an image configuration.

As the toner particles are depleted from the developer material, it is necessary to dispense additional toner particles into the developer mixture. Then newly added toner is typically mixed in some manner with the denuded carrier particles and unused developer material.

Various prior art devices have been devised to accomplish the mixing function. A preferred system for accomplishing the crossmixing function is the use of a dual auger system to transport the toner in two directions and achieve a toner interchange between augers. Dual auger systems are disclosed, for example, in the following prior art documents.

U.S. Pat. No. 4,274,362 to Beck et al. discloses magnetic brush mixing augers made of twisted strips of aluminum sheet metal with smooth axial edges. In a developing unit, the auger members are located in the sump portion of a developing pan where they circulate, distribute and intermix dry toner. A dispensing system evenly distributes regular amounts of toner while the copier is operable.

U.S. Pat. No. 4,056,076 to Smith, assigned to Xerox Corporation, discloses a crossmixing system for mixing and charging multicomponent developer in a circulating development system of an electrostatographic processor. A pair of parallel passive crossmixers are used as mixing devices and a single active crossmixer is used as a blending (triboelectric charging) device.

These prior art patents described above are representative of the dual auger crossmixing type of system. The common characteristic of these systems is the axis of each auger pair lie essentially in the same horizontal plane with developer exchange between each auger taking place at end locations. A problem with this inter-auger transfer is that the developer is exchanged by a sideways pushing application which requires that the augers be physically close to each other. For some systems, this proximity requirement may present a space or geometry problem. A second difficulty with this "push" inter-auger transfer is the tendency for the developer to "bunch up" at the transfer end, sometimes resulting in toner spilling over into other areas of the developer housing unless specific seals are placed at strategic locations. A third difficulty is that systems having physical augers forces the material in the area of the sump where the auger is closest to the housing, causing packing of the material and in some instances failure of the auger or material property changes as the material binds together under pressure. Yet another difficulty is that the friction caused by systems which physically push powdered materials by contact augers causes heating and spatial non-uniformities, such as tunnels and tenting, in the materials being transported. This often can result in poor mixing, poor loading, and even toner block (fusing of the toner material in the housing instead of when heated on the print).

Applicant has also found that the physical separation of the toner into sections by fins in a physical auger can produce differential loading of the mag brush in an auger fed developer system and that the magnetic fields generated by the mag brush donor roll strongly affects the toner in the augers and appears to influence loading of the donor roll in a way to enhance the auger screw pitch separation. This has contributed to diagonal bands (auger mark print defects) being developed onto prints.

Briefly, the present invention obviates the problems noted above by utilizing a development system including a housing, a developer roll mounted in said housing, for depositing marking particles on an imaging surface having an electrostatic latent image thereon, an auger, for mixing and transporting the marking particles and carrier constituents of the developing material and; transferring mixed developer material to said developer roll, said auger comprising an elongate strip of magnetic material having a helix structure; a nonmagnetic sleeve enclosing said elongate strip of magnetic material; and means for rotating said elongate strip of magnetic material within said nonmagnetic sleeve, said elongate strip of magnetic material generates a magnetic field for transporting said developer material axially along an outer surface of said nonmagnetic sleeve when rotated by said rotating means. The system is uniquely characterized in that the preferred embodiment can be implemented with no moving parts of the auger touching the developer material while it is mixing and moving it.

DESCRIPTION OF THE INVENTION

Figure 1:
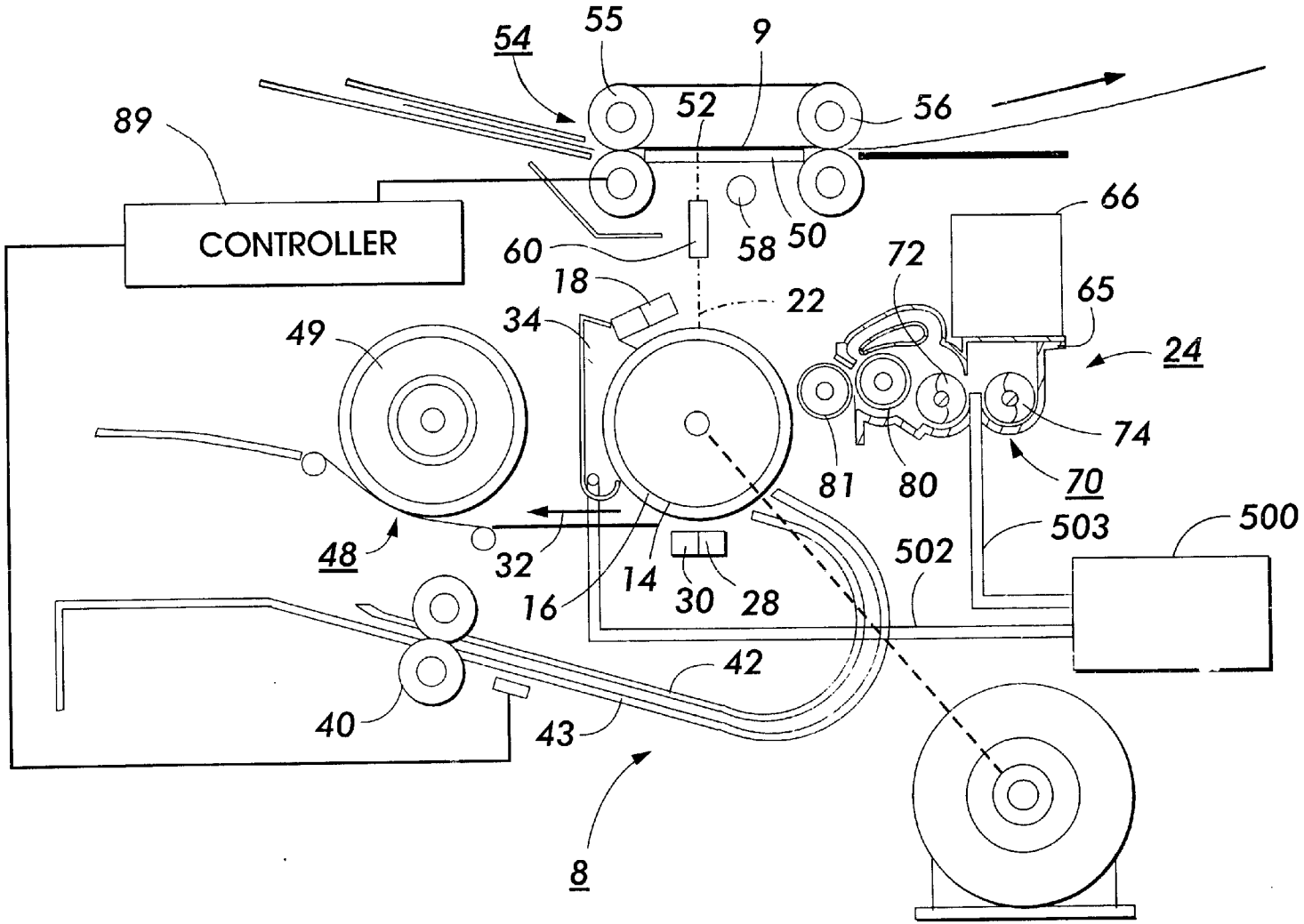
FIG. 1 is a side view of a xerographic reproduction machine incorporating the dual auger mixing assembly of the present invention.
Figure 2:
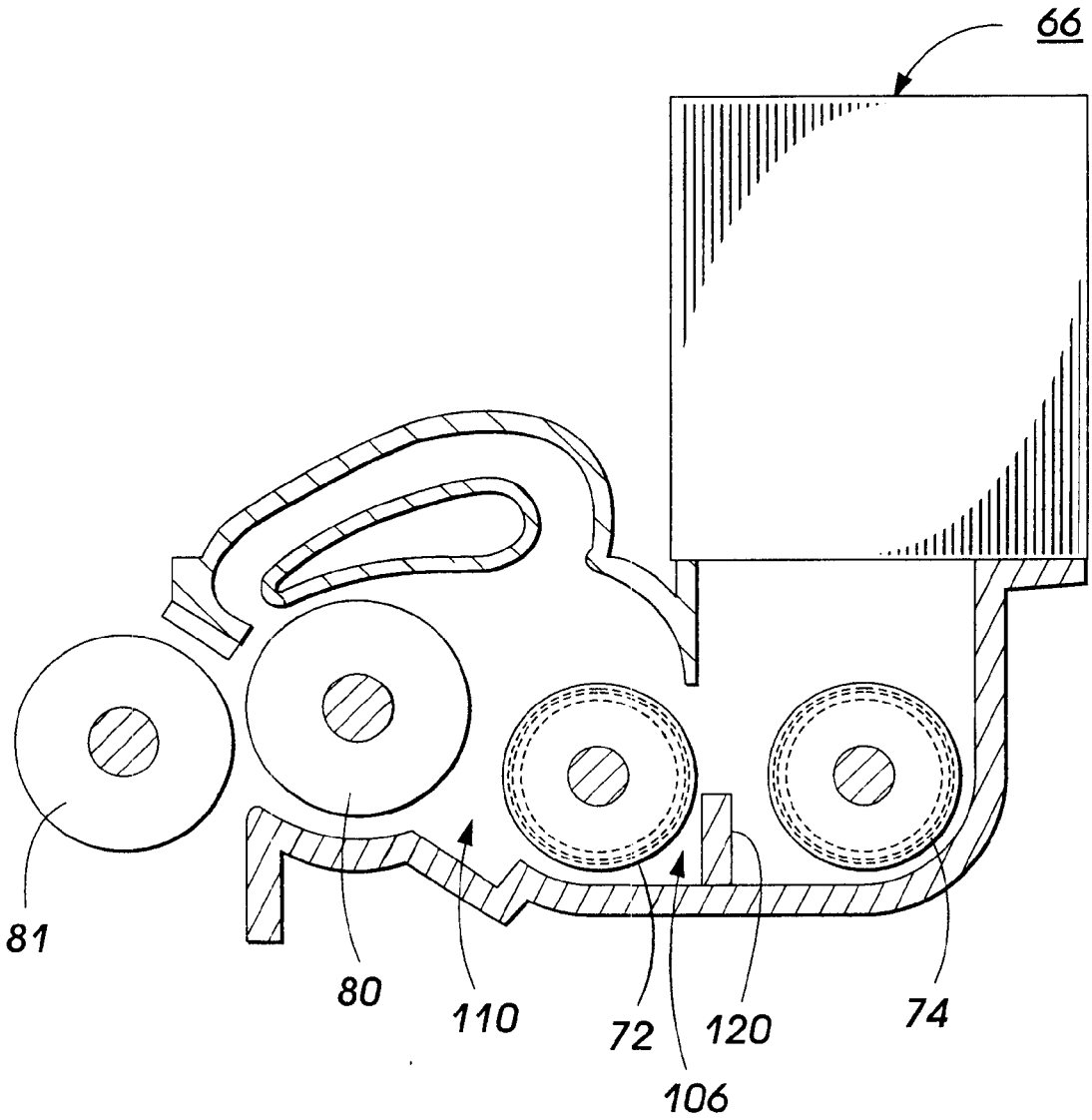
FIG. 2 is an enlarged of the developer assembly shown in FIG. 1.

Referring to FIG. 1 of the drawings, there is shown a xerographic type reproduction machine 8 incorporating the dual auger mixing assembly of the present invention, designated generally by the numeral 10. Machine 8 has a suitable frame (not shown) on which the machine xerographic components are operatively supported.

Briefly, and as will be familiar to those skilled in the art, the machine xerographic components include a recording member, shown here in the form of a rotatable photoreceptor 14. In the exemplary arrangement shown, photoreceptor 14 comprises a drum having a photoconductive surface 16. Operatively disposed about the periphery of photoreceptor 14 are a charge corotron 18 for placing a uniform charge on the photoconductive surface 16 of photoreceptor 14; an exposure station 22 where the previously charged photoconductive surface 16 is exposed to image rays of a document 9 being copied or printed; development station 24 where the latent electrostatic image created on photoconductive surface 16 is developed by toner; and transfer detack corotrons 28 and 30 for assisting transfer of the developed image to a suitable copy substrate material such as a copy sheet 32 brought forward in timed relation with the developed image on photoconductive surface 16. Residual toner is removed from the drum surface at cleaning station 34 and is deposited in waste container 500 via waste tube 502 in the case of magnetic toner, the waste tube can contain a magnetic auger of the present invention.

Copy sheets 32 are brought forward to the transfer area by feed roll pair 40, sheet guides 42, 43 serving to guide the sheet through an approximately 180 degree turn prior to the transfer area. Following transfer, the sheet 32 is carried forward to a fusing station 48 where the toner image is fixed by fusing roll 49. After fusing, the copy sheet 32 is discharged to an output tray.

A transparent platen 50 supports the document 9 as the document is moved past a scan point 52 by a constant velocity type transport 54. As will be understood, scan point 52 is in effect a scan line extending across the width of platen 50 at a desired point along the platen where the document is scanned line by line as the document is moved along platen 50 by transport 54. Transport 54 has input and output document feed roll pairs 55, 56, respectively, on each side of scan point 52 for moving document 9 across platen 50 at a predetermined speed. RIS/ROS 58 is provided to scan in images from platen 50 and RIS/ROS 58 exposes the image onto the photoconductive surface 16 of the moving photoreceptor 14.

Developer station 24 includes a developer housing 65 in which a toner dispensing cartridge 66 is rotatably mounted so as to dispense toner particles and developer material downward into a sump area occupied by the dual magnetic auger mixing assembly 70 of the present invention. Assembly 70 includes a pair of mounted augers 72, 74. Further details of the construction and operation of assembly 70 are provided below.

Continuing with the description of the developer station 24, a magnetic brush developer roll 80 is disposed in predetermined operative relation to the photoconductive surface 16 of photoreceptor 14, the length of developer roll 80 being equal to or slightly greater than the width of photoconductive surface 16, with the axis of roll 80 parallel to the axis of photoreceptor 14. Developer roll 80 has a plurality of stationary magnet assemblies 81 disposed within a rotatable cylinder or sleeve 75, sleeve 75 being rotatably journaled for rotation in the opposing sides of developer housing 65. Magnet assemblies 81 are arranged so that as sleeve 75 rotates, developer is attracted to the exterior surface of sleeve 75 to form a brush-like layer 82 on sleeve 75. Rotation of sleeve 75 carries the developer brush 82 into developing relation with the photoconductive surface 16 of photoreceptor 14 to develop the latent electrostatic image therein.

A suitable controller 89 is provided for operating the various components of machine 8 in predetermined relation with one another to produce copies. In operation, machine 8 is actuated by a suitable start control button. The document to be copied is then inserted into the nip of document transport roll pair 55, 56 which carries the document across platen 50. As the leading edge of the document reaches a detector, controller 89, in response to the signal from the detector, starts feed roll pair 40 to advance the copy sheet 32 forward in timed relation with the document 9 as the document is transported across platen 50 and past scan point 52 by document transport 54. The document image developed on the photoconductive surface 16 of photoreceptor 14 is transferred to copy sheet 32 as the copy sheet moves through the transfer area. Following transfer, the copy sheet 32 passes to fusing station 48 where the image is fixed.

As latent images are formed, and developer and toner depleted, fresh toner is dispensed as dispenser cartridge 66 rotates. Auger 72 continually mixes the fresh toner with the denuded carrier particles and existing developer. As the auger 72 rotates in a counterclockwise direction, and with magnetic segments 104 having an orientation as shown, the mixture is conveyed from right to left in FIG. 3 and onto the page in FIG. 4. The mixture then transfers into the auger 74 system, which carries the developer uphill to the retransfer point. The system is thus constantly ensuring that freshly added toner is constantly being mixed into the existing developer.

Turning now to a more detailed description of the developer station 24, and particularly the auger mixing assembly 70, auger 72 is driven by motor means (not shown) in a counterclockwise direction. Supported beneath auger 72 is a trough 106 extending the length of the auger. Supported above auger 72 is pickoff baffle portion of trough having a series of ports (not shown) extending therethrough permitting toner from housing 66 to be dispensed area sump 110 where it is then picked up by the exterior surface of sleeve 75 to form the toner brush. Auger 74 is mounted on shaft 116 and driven by appropriate motor means in a clockwise direction.baffle portion of trough having a series of ports (not shown) extending therethrough permitting toner from housing 66 to be dispensed through the ports in a steady flow downward into the mixing assembly area sump 110 where it is then picked up by the exterior surface of sleeve 75 to form the toner brush. Auger 74 is mounted on shaft 116 and driven by appropriate motor means in a clockwise direction.

Figure 3:
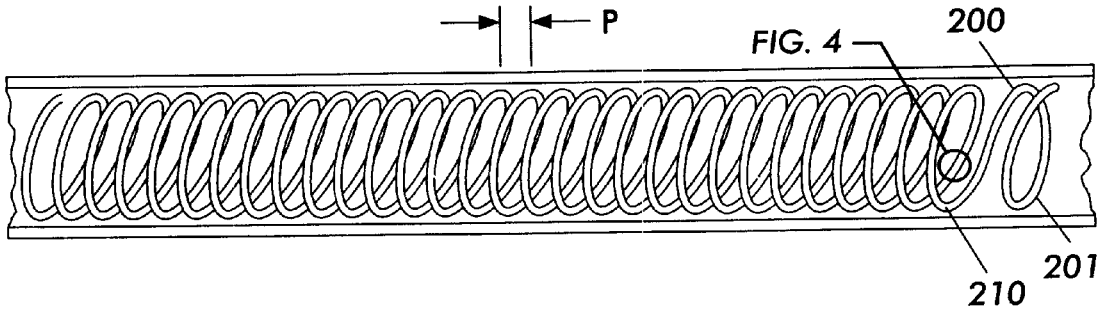
FIG. 3 is an enlarged side view of the magnetic auger assembly.
Figure 4:
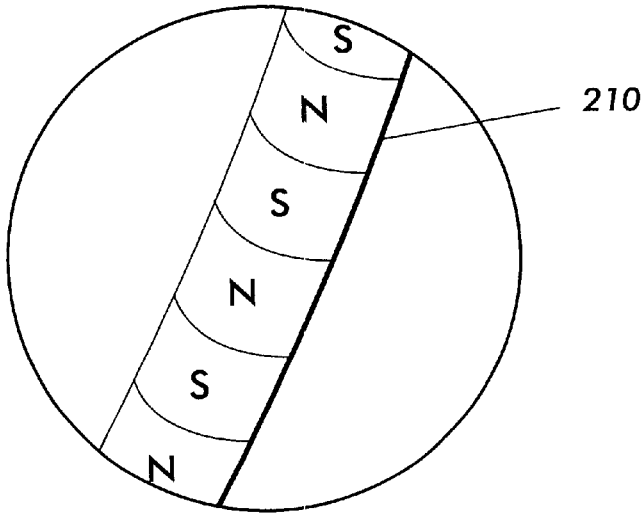
FIG. 4 is a cross section view of the magnetic auger assembly shown in FIG. 3.

The invention, as shown in one embodiment in FIG. 3 and FIG. 4, magnetic member 210 consists of a single helix or multiple set of helixes (barber pole arrangement) of magnetic poles arranged alternating north, south, N, S, etc., in 1 to 5 mm segments to completely span the region of interest. Around this helical construct is a plastic or nonmagnetic metal sleeve 200 arranged such that the magnets are in proximity to the inside of the thin sleeve but need not rub or touch. Mechanisms are added (motors, belts, etc.) to rotate either the magnetic helixes as one unit or the sleeve as one unit (they need not move laterally). It is noted as a further enhancement that a small reverse helix near the end can prevent toner from packing near the ends. Here the relative motion moves developer laterally depending on the sense of rotation. The magnetic material moves from N to S to N in a walking motion as the relative motion of the sleeves and magnet project alternating magnetic fields out into the developer sump.

The developer is transferred from auger 72 to auger 74 by gravitational force acting on the toner. Auger 74 then mixes the developer. The developer then falls into sump 110 or is again picked up by auger 72. A trickle port 504 is located between two augers on the end of a developer housing.

Tickle waste toner and cleaner waste empties into a single container. The augers speed is balanced to maintain a constant trickle flow out of the housing while maintaining the required developer sump level.

This present invention utilizes the ability of magnetic fields to walk magnetic material. It consists of magnetic poles arranged alternately along a helix forming a system that looks like the coils of an open spring. As the helix and nonmagnetic shell undergo relative cylindrical motion, any magnetic material on or near the outside of the sleeve will walk toward the magnetic pole moving toward it (opposite the direction of magnet motion) thus will move laterally and around. If the material meets an area already filled with material, it will release its magnetic hold on the sleeve without packing the material it meets. Likewise, in regions of packed material (like at the bottom of a sump), magnetic material will walk out of these regions as soon as the magnetic force overcomes the resistance. This is much different than the scooping force exerted on sump materials by mechanical screw augers, which push the material laterally with an angled and curved blade. Because the forces are magnetic and carried through the material being carried, this system will also pull toner from corners and edges that cannot ever be reached by mechanical augers.

This present invention has some distinct advantages over current methods. First, since the connection of the material to the sleeve is magnetic and not physical, such as toner within the blades of an auger, the developer can release from the sleeve when it encounters a filled sump area. Current augers force the toner down into these already existent piles, usually causing heat and packing and many dead spots. Secondly, while inspecting the operation of a current HSD housing, it was observed that the current mechanical augers were strongly affected by the field of the mag roll, and thus toner that was about to load onto the roll was pulled from the filled regions between the blades of the auger and left large areas without developer touching them, leading to non-uniform reload and producing from that a print defect known as auger marks. The strong N S N S fields from this invention, interacting with the fields from the long axial magnets from the developer roll will produce areas of null field and high alternating field in regions where old housing had only strong unidirectional fields. Thus, the randomness and alternating nature of the field produces a more uniform reload. Thus, this new system prevents packing, prevents dead spots in the sump because they are unreached by the auger, can be non-moving in the regions contacting the toner, gives more uniform donor roll reload, and in general provides a more efficient and less stressful method of uniformly moving the magnetic materials laterally.

Further a small reverse coil portion 201 placed near either end of a system designed to rotate only one way is a very efficient method of moving toner away from the bearings and the ends of the housings where it usually becomes most tightly packed.

Another feature of the invention is that the pitch of the helix can be adjusted to set the ratio of the mixing function and transporting function of the auger. For example, with a finer pitch increases the mixing function of the present invention and slows down material speed moving along the auger at a set rotation speed. A larger pitch increases the material speed moving along the auger at the set rotation speed with less mixing of the material.

Although this invention was specifically designed to improve the workings of the HSD and HJD housings now the primary developer system, it is clear that the same usefulness will be advantageous in any system that currently uses an auger to move materials that are magnetic.

While the invention has been described with reference to the structure disclosed, it is not confined to the specific details set forth, but is intended to cover such modifications or changes as may come within the scope of the following claims.

I claim:

1. In a development system including a housing, a developer roll mounted in said housing, for depositing marking particles on an imaging surface having an electrostatic latent image thereon, an auger, for mixing the marking particles and magnetic carrier constituents of the developing material and; transferring mixed developer material to said developer roll, said auger comprising:

an elongate strip of magnetic material having a helix structure; said helix has a predefined pitch wherein said predefine pitch of the helix can be adjusted to set the ratio of the mixing function and transporting function of the auger;

a nonmagnetic sleeve enclosing said elongate strip of magnetic material; and means for rotating said elongate strip of magnetic material relative to said nonmagnetic sleeve, said elongate strip of magnetic material generates a magnetic field for transporting said developer material axially along an outer surface of said nonmagnetic sleeve when rotated by said rotating means.

2. The development system of claim 1, wherein, said elongate strip of magnetic material consisting of alternating poles segments of magnetic material arranged in said helix structure.

3. The development system of claim 2, wherein said alternating poles segments are 1 to 5 mm in length.

4. The development system of claim 1, further including a reverse helix structure portion connected to said helix structure.

5. The development system of claim 4, wherein said reverse helix structure portion is positioned near an end portion of the helix structure for transporting material away from the end portion thereby preventing material from bunching up and spilling over in said housing.

6. A system for transporting and mixing magnetic particles comprising: an auger including:

an elongate strip of magnetic material having a helix structure said helix has a predefined pitch wherein said predefine pitch of the helix can be adjusted to set the ratio of the mixing function and transporting function of the auger;

a nonmagnetic sleeve enclosing said elongate strip of magnetic material; and means for rotating said elongate strip of magnetic material relative to said nonmagnetic sleeve, said elongate strip of magnetic material generates a magnetic field for transporting said magnetic particles axially along an outer surface of said nonmagnetic sleeve when rotated by said rotating means.

7. The system of claim 6, wherein, said elongate strip of magnetic material consisting of alternating poles segments of magnetic material arranged in said helix structure.

8. The system of claim 6, further including a reverse helix structure portion connected to said helix structure.

9. The system of claim 6, wherein said alternating poles segments are 1 to 5 mm in length.

* * * * *

UNITED STATES PATENT AND TRADEMARK OFFICE

CERTIFICATE OF CORRECTION

PATENT NO. : 6,510,304 B2
DATED : January 21, 2003
INVENTOR(S) : Dennis A. Abramsohn It is certified that error appears in the above-identified patent and that said Letters Patent is hereby corrected as shown below:

Title page, Item [54] and Column 1, line 1,
Please delete "ELELCTROGRAPHIC" and insert -- ELECTROGRAPHIC --.

Signed and Sealed this

First Day of July, 2003

JAMES E. ROGAN
*Director of the United States Patent and Trademark Office*